US011309634B2

(12) United States Patent
Jiang et al.

(10) Patent No.: US 11,309,634 B2
(45) Date of Patent: Apr. 19, 2022

(54) METHOD FOR SYNTHESIZING VORTEX ELECTROMAGNETIC WAVE CARRYING HIGH ORBITAL ANGULAR MOMENTUM (OAM) MODE

(71) Applicants: CHENGDU INSTITUTE OF BIOLOGY, CHINESE ACADEMY OF SCIENCES, Sichuan (CN); UNIVERSITY OF ELECTRONIC SCIENCE AND TECHNOLOGY OF CHINA, Sichuan (CN)

(72) Inventors: Haibo Jiang, Sichuan (CN); Zijun Chen, Sichuan (CN); Yubin Gong, Sichuan (CN); Yang Yang, Sichuan (CN); Shaomeng Wang, Sichuan (CN); Chengbo Gui, Sichuan (CN); Jiangnan Fu, Sichuan (CN); Xinyang He, Sichuan (CN)

(73) Assignees: CHENGDU INSTITUTE OF BIOLOGY, CHINESE ACADEMY OF SCIENCES, Sichuan (CN); UNIVERSITY OF ELECTRONIC SCIENCE AND TECHNOLOGY OF CHINA, Sichuan (CN)

( * ) Notice: Subject to any disclaimer, the term of this patent is extended or adjusted under 35 U.S.C. 154(b) by 0 days.

(21) Appl. No.: 17/439,759

(22) PCT Filed: Aug. 28, 2020

(86) PCT No.: PCT/CN2020/112154
§ 371 (c)(1),
(2) Date: Sep. 15, 2021

(87) PCT Pub. No.: WO2022/007148
PCT Pub. Date: Jan. 13, 2022

(65) Prior Publication Data

US 2022/0094068 A1 Mar. 24, 2022

(30) Foreign Application Priority Data

Jul. 6, 2020 (CN) ..... 202010641809.8

(51) Int. Cl.
*H01Q 15/00* (2006.01)
*H01Q 21/00* (2006.01)
(Continued)

(52) U.S. Cl.
CPC ..... *H01Q 15/0086* (2013.01); *H01Q 3/267* (2013.01); *H01Q 3/40* (2013.01); *H01Q 21/00* (2013.01); *H01Q 21/20* (2013.01)

(58) Field of Classification Search
CPC ..... H01Q 21/20; H01Q 21/00; H01Q 3/36; H01Q 3/267; H01Q 3/40
See application file for complete search history.

(56) References Cited

U.S. PATENT DOCUMENTS 10,228,443 B2 * 3/2019 Kulaib ..... G01S 3/74
10,665,960 B2 * 5/2020 Sacco ..... H04L 5/04
(Continued)

FOREIGN PATENT DOCUMENTS

CN 107134659 A * 9/2017
CN 107645068 A 1/2018
(Continued)

OTHER PUBLICATIONS

Synthesis of Adaptive Uniform Circular Array Using Normalized Fractional Least Mean Squares Algorithm. G. Viswanadh Raviteja et al. (Year: 2016).*
(Continued)

*Primary Examiner* — Vibol Tan
(74) *Attorney, Agent, or Firm* — Novick, Kim & Lee, PLLC; Allen Xue

(57) ABSTRACT

A novel synthetic uniform circular array (SUCA) method for generating vortex electromagnetic (EM) wave carrying high
(Continued)

orbital angular momentum (OAM) mode has the following steps. N antenna elements are placed radially to form a uniform circular array (UCA), where N is a positive integer. By rotating the array elements to various spatial locations, modifying their feeding phases, and superimposing the generated fields at various spatial locations, SUCA can beat the limit of space and configure more array elements to generate vortex electromagnetic (EM) waves carrying high mode OAMs. Meanwhile, due to the more synthetic array elements and smaller aperture than the traditional UCA, the purity of OAM mode is higher and it is more flexible to adjust the main lobe directions of these vortex waves carrying different OAM modes, and can generate vortex EM waves.

17 Claims, 2 Drawing Sheets

(51) Int. Cl.

| | |
|---|---|
| ***H01Q 21/20*** | (2006.01) |
| ***H01Q 3/26*** | (2006.01) |
| ***H01Q 3/40*** | (2006.01) |

(56) References Cited

U.S. PATENT DOCUMENTS

| | | | | |
|---|---|---|---|---|
| 10,790,586 | B2 * | 9/2020 | Klemes | H01Q 21/20 |
| 2004/0217675 | A1 | 11/2004 | Desilets et al. | |
| 2013/0321207 | A1 * | 12/2013 | Monogioudis | H01Q 1/246 342/373 |
| 2019/0296450 | A1 * | 9/2019 | Zhao | H04B 7/084 |
| 2019/0341694 | A1 | 11/2019 | Zou et al. | |

FOREIGN PATENT DOCUMENTS

| | | | | |
|---|---|---|---|---|
| CN | 108134756 | A | * | 6/2018 |
| CN | 108594221 | A | | 9/2018 |
| CN | 108767474 | A | | 11/2018 |
| CN | 108767495 | A | * | 11/2018 |
| CN | 108987939 | A | * | 12/2018 |
| CN | 109167171 | A | | 1/2019 |
| CN | 109755765 | A | | 5/2019 |
| CN | 110146953 | A | | 8/2019 |
| CN | 113381794 | A | * | 9/2021 |

OTHER PUBLICATIONS

Pattern Synthesis of Uniform Circular Arrays with Directive Elements. C. Suarez et al. (Year: 2004).*

Synthesis of Circular Array Antenna for Sidelobe Level and Aperture Size Control Using Flower Pollination Algorithm. V. S. S. S. Chakravarthy Vedula et al. (Year: 2015).*

Wang, Jianqiu et al., Vortex SAR Imaging Method Based on OAM Beams Design, IEEE Sensors Journal, Aug. 28, 2019.

Guo, Zhongyi et al.; Advances of Research on Antenna Technology of Vortex Electromagnetic Waves, Journal of Radar, vol. 8, No. 5 Oct. 11, 2019, pp. 632-648.

Liu, Kang et al.; Backward Scattering of Electrically Large Standard Objects Illuminated by OAM Beams, IEEE, vol. 19, No. 7, Nov. 5, 2020, entire article.

* cited by examiner

METHOD FOR SYNTHESIZING VORTEX ELECTROMAGNETIC WAVE CARRYING HIGH ORBITAL ANGULAR MOMENTUM (OAM) MODE

TECHNICAL FIELD

The present invention belongs to the new technical field of microwave (electromagnetic wave) imaging, and particularly relates to a method for synthesizing vortex electromagnetic (EM) wave carrying high orbital angular momentum (OAM) mode.

BACKGROUND TECHNOLOGY

Orbital Angular Momentum (OAM) is an important physical value of the vortex electromagnetic (EM) field, and studies have indicated that vortex EM waves carrying different OAM modes are orthogonal each other, and more information can be modulated on it. Therefore, the researchers have extensively investigated the applications of vortex EM wave carrying OAM in many fields, such as communication and imaging. The radiated fields of vortex EM wave carrying different OAM modes have the different intensity and phase distributions in the plane perpendicular to the direction of propagation. And the phase distributions present a regular distribution feature, which is the helix phase wavefront around the propagation direction. Meanwhile, this spatial phase distributions can be regarded as the result of simultaneous irradiation of multiple plane waves from successively different azimuth angles, which provides a physical basis for the high-resolution target imaging.

At present, vortex EM waves carrying OAM have received extensive attentions in wireless communications and radar imaging. The far field distributions of the EM wave radiated by traditional radar is similar to a plane wave. Its high range resolution is obtained by transmitting broadband signals while its high azimuth resolution is obtained through the virtual synthetic aperture formed by the lateral relative movement of the radar and the target. However, the real-aperture radar has the same azimuth radiation signal in one wavebeam, thus it is difficult to achieve high-resolution azimuth imaging.

In addition, as for the traditional method, the antenna elements are evenly distributed on the ring. In the case that the ring radius is fixed, through increasing the number of antenna elements, the number of OAM modes carried by the generated vortex EM wave can be increased accordingly. However, in practical application engineering, the antenna has a certain volume and the ring has a certain radius, and the number of total antennas is limited, thus the number of these generated OAM modes will also be limited. The imaging resolution in the actual system may also be limited. Chinese patent CN 109936391 B discloses a method for generating multi-mode vortex electromagnetic waves based on a single antenna. This patent includes three main parts. The first one is using a single antenna to construct a single antenna model which performs uniform circular motion. The second part is equating the single antenna model to an equivalent circular antenna array. The last part is decomposing the radiated electric field of the equivalent circular antenna array and expanding the radiated electric field by Fourier series to obtain the $m^{th}$ harmonic. Therefore, we can obtain vortex EM waves carrying different OAM modes after simplification. In particular, this patent uses Fourier expansion to obtain the $m^{th}$ harmonic, and simplifies the radiated field of the $m^{th}$ harmonic to obtain a vortex EM wave carrying OAM mode m. However, using the method of this patent cannot directly obtain a single vortex EM wave carrying OAM mode number of m, but only a vortex EM wave containing OAM mode m. In fact, the method, which can directly generate vortex EM wave, may also produce vortex EM wave carrying high OAM mode by Fourier expansion, so it is of little significance in practical applications. In addition, the method for generating multi-mode vortex EM waves disclosed in this patent is directly related to time t, and the obtained $m^{th}$ harmonic radiated electric field is also limited by time t.

In addition to the fields of wireless communication and radar imaging, vortex EM waves are also expected to be used in the field of biomedical imaging, which provides new ideas for the diagnosis and treatment of diseases. However, there is no report on the use of vortex EM waves in biomedical imaging. In order to meet the demand for vortex EM waves in practical applications, a direct synthesis method for vortex EM waves has been developed. This method uses fewer elements, and the number of OAM modes can be freely controlled as required. That is of great significance for the further use of vortex EM waves in the fields of biomedical imaging, radar imaging, wireless communication and so on.

Content of the Invention

The object of the present invention is to provide a novel synthetic uniform circular array (SUCA) method which, using fewer elements, can directly generate vortex EM waves carrying high OAM modal numbers and purity, as required, by rotating the array elements to various spatial locations and modifying their feeding phases.

The present invention provides a SUCA method for generating vortex EM wave, which is to form a radially placed UCA with N elements, where N is a positive integer, and then by rotating the array elements to various spatial locations, modifying their feeding phases, and superimposing the generated fields at various spatial locations, vortex EM waves can be generated.

Further, the method includes the following steps: (1) N antenna elements are arranged on a circular ring to form an UCA; (2) N antenna elements are fed at the initial position to emit EM waves with the initial phase; (3) By rotating the array elements to various spatial locations and modifying their feeding phases, the phase-controlled EM waves are emitted; (4) The EM waves emitted in step (2) and step (3) are superimposed to generate vortex EM waves.

Further, said step (1) also includes determining the OAM mode number $\alpha'$ of the synthesized vortex EM wave, and determining the elements number Ns of the virtual synthesized antenna array; where Ns=kN, k>0, and k is an integer.

Further, in said step (2), the phase of the EM wave emitted by the $n^{th}$ element is:

$$\alpha' * \frac{2\pi(n-1)}{N},$$

where $1 \le n \le N$, and n is an integer;

Further, the specific operation method of step (3) is: rotating the antenna array around the central axis of the ring in a set direction, and feeding the N antenna elements for emitting the EM waves from the position after rotation;

the antenna array is rotated a total of s times, and the angle of each rotation is $$\frac{2\pi}{N_s};$$

after the antenna array is rotated for the $i^{th}$ time, the phase of the EM wave emitted by the $n^{th}$ antenna elements is:

$$\alpha' * \frac{2\pi(n-1)}{N} + \alpha' * \frac{2\pi}{N_s} * i;$$

wherein, s=k−1; 1≤i≤s, and the rotation direction is clockwise or counterclockwise.

Further, the antenna element is a circularly polarized antenna.

Further, the antenna element is a linearly polarized antenna. In step (3), after each rotation of the antenna array, each antenna element also needs to rotate $$\frac{2\pi}{N_s}$$

around itself in a direction which is opposite to the rotation of the antenna array.

Further, in step (1), the N antenna elements are evenly arranged on a circular ring.

Further, in step (3), the rotation is controlled by a precision rotating platform. The radius of the circular antenna array is adjustable. Preferably, the radius of the circular antenna array can be adjusted according to the OAM mode number of vortex EM wave or the requirements of imaging system.

The present invention also provides the vortex EM wave synthesized by the method mentioned above.

The present invention also provides the use of the vortex EM wave mentioned above in super-resolution biomedical imaging, communication, or radar imaging.

The present invention further provides the use of the vortex EM wave mentioned above in the preparation of equipment for super-resolution biomedical imaging, communication, or radar imaging In the present invention, "*" means multiplication.

In the novel SUCA method for generating vortex EM wave carrying high OAM mode in the present invention, the antenna element may be a circularly polarized antenna or a linearly polarized antenna. When the antenna element is a circularly polarized antenna, the control method is: rotating the antenna array and adjusting the phase of each antenna element. When the antenna element is a linearly polarized antenna, the control method is: rotating the antenna array and adjusting the phase of each antenna element. Then, after each rotation of the antenna array, rotating each antenna element the same angle in the opposite direction to the rotation of the antenna array around itself, to ensure that the polarization direction of each antenna element is the same.

Compared with the prior art CN 109936391 B, a method for generating multi-mode vortex EM waves based on a single antenna, the present invention does not require Fourier expansion to obtain vortex EM wave carrying higher OAM mode. In the contrast, that required vortex EM waves can be directly generated. Moreover, the method of synthesizing multi-mode vortex EM waves disclosed in CN 109936391 B is limited by time, in which the phase adjustment process for the antenna is not included, and thus an independent vortex EM wave carrying high OAM mode cannot be directly generated. However, our proposed method in the present invention is only related to the spatial position and the feeding phases to the antenna elements, thus the synthetic method of the present invention is not limited by time.

The proposed method for synthesizing the vortex electromagnetic wave carrying high OAM mode in the present invention is simple and easy to operate. As for this method, using fewer antenna elements, the required vortex EM wave can be generated easily by rotating the antenna elements and adjusting their feeding phases. In conclusion, our proposed SUCA is potential to generate high quality vortex EM waves carrying high mode OAMs, which can be used to improve the azimuth imaging resolution.

The vortex EM wave synthesized by the method of the present invention can not only be used in the fields of radar imaging and wireless communication, but also has significant advantages in super-resolution biomedical imaging. Therefore, the vortex EM wave synthesized by the method of the present invention has very good application prospects in the fields of super-resolution biomedical imaging, radar imaging, and wireless communication and so on.

Obviously, based on above content of the present invention, according to the common technical knowledge and the conventional means in the field, without department from above basic technical spirits, other various modifications, alternations, or changes can further be made.

By following specific examples of said embodiments, above content of the present invention is further illustrated. But it should not be construed that the scope of above subject of the present invention is limited to following examples. The techniques realized based on above content of the present invention are all within the scope of the present invention.

EXAMPLES

The starting materials and equipment used in the present invention are all known products, which are obtained by purchasing commercially available products.

Example 1 The Synthetic Method of Vortex Electromagnetic Wave According to the Present Invention Based on Circularly Polarized Antennas 1. 8 circularly polarized antennas were evenly distributed on a circle with a radius of 140 mm, and the ring was controlled by a precision rotating platform. In this example, the vortex EM wave carrying OAM mode 10 was to be synthesized, the number of antenna array elements for virtual synthesis was 32. That is, in this example, 8 circularly polarized antenna array elements were used, and a virtual synthetic circular array with 32 array elements was virtually synthesized, then the vortex EM wave carrying OAM mode 10 was synthesized.

Once the elements number of the virtual synthesis array, the number of OAM mode carried by the generated vortex EM wave, and the elements number of the original antenna array were determined, the angle of each rotation and the feeding phase distributions to the antenna element could be determined. It was calculated that the entire antenna array needed to be rotated 3 times, and the angle of each rotation is $$\frac{2\pi}{N_s} = \frac{2\pi}{32} = \frac{\pi}{16}.$$

2. In the original position, 8 antenna elements were respectively denoted as $A_1, A_2, A_3, A_4, A_5, A_6, A_7, A_8$. Then, the phase of the EM wave emitted by $A_n$ was:

$$\alpha' * \frac{2\pi(n-1)}{N}, \text{ i.e. } 10 * \frac{2\pi(n-1)}{8},$$

$1 \leq n \leq 8$, and n is an integer. The EM wave emitted by the entire antenna array was shown in column C1 in FIG. 2. The upper figure of column C1 is the intensity distribution of E-field; the lower figure of column C1 is the phase distribution of E-field.

After emitting the EM wave spectrum at the original position, the entire ring array was rotated $$\frac{2\pi}{32} = \frac{\pi}{16}$$

clockwise, and the second EM wave was emitted: the phase for $A_n$ was $$\alpha' * \frac{2\pi(n-1)}{N} + \alpha' * \frac{2\pi}{N_s}, \text{ i.e. } 10 * \frac{2\pi(n-1)}{8} + 10 * \frac{2\pi}{32}.$$

Figure 2:
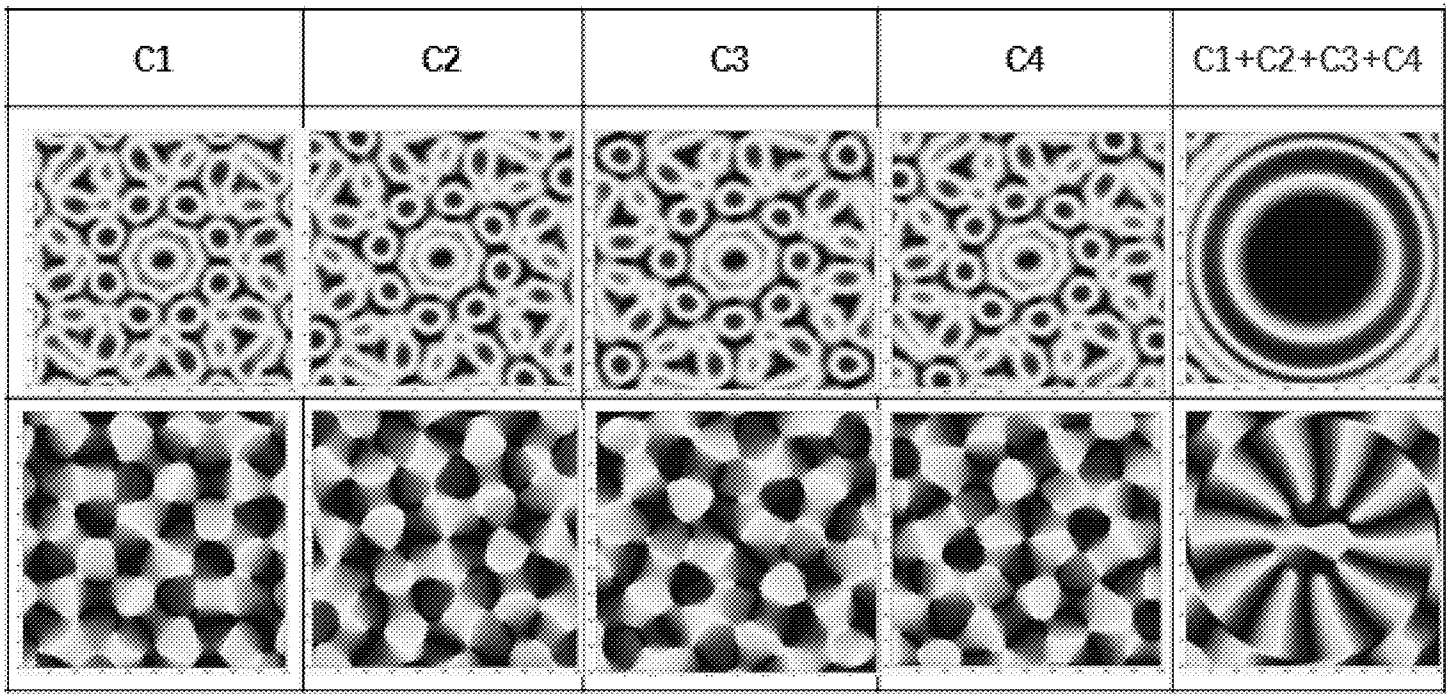
FIG. 2: The intensity (upper figure) and the phase distribution (lower figure) of the vortex EM wave synthesized in Example 1 of the present invention. Observation surface: 80 mm*80 mm; observation distance: 400 mm.

The EM wave emitted by the entire antenna array was shown in column C2 in FIG. 2. The upper figure of column C2 is intensity distribution of E-field; the lower figure of column C2 is the phase distribution of E-field.

After emitting the second EM wave spectrum, the entire ring array was further rotated $$\frac{2\pi}{32} = \frac{\pi}{16}$$

clockwise, and the third EM wave was emitted: the phase for $A_n$ was $$\alpha' * \frac{2\pi(n-1)}{N} + \alpha' * \frac{2\pi}{N_s} * 2, \text{ i.e. } 10 * \frac{2\pi(n-1)}{8} + 10 * \frac{2\pi}{32} * 2.$$

The EM wave emitted by the entire antenna array was shown in column C3 in FIG. 2. The upper figure of column C3 is the intensity distribution of E-field; the lower figure of column C3 is the phase distribution of E-field.

After emitting the third EM wave spectrum, the entire ring array was further rotated $$\frac{2\pi}{32} = \frac{\pi}{16}$$

clockwise, and the forth EM wave was emitted: the phase for $A_n$ was $$\alpha' * \frac{2\pi(n-1)}{N} + \alpha' * \frac{2\pi}{N_s} * 3 = 10 * \frac{2\pi(n-1)}{8} + 10 * \frac{2\pi}{32} * 3.$$

The EM wave emitted by the entire antenna array was shown in column C4 in FIG. 2. The upper figure of column C4 is the intensity distribution of E-field; the lower figure of column C4 is the phase distribution of E-field.

Finally, by superimposing the EM spectra of four emissions, the vortex EM wave carrying OAM mode 10 could be obtained, that is, the vortex EM wave could be synthesized from the EM waves emitted by the entire antenna array. As shown in the columns (C1+C2+C3+C4) in FIG. 2, the upper figures in the columns (C1+C2+C3+C4) were the intensity distributions of E-field; the lower figures in the columns (C1+C2+C3+C4) were the phase distributions of E-field.

Comparative Example 1 Using Traditional Methods to Synthesize Vortex Electromagnetic Waves Using traditional method UCA, 8 circularly polarized antennas were evenly distributed on a circle with a radius of 140 mm, and EM waves were emitted to synthesize vortex EM waves. The number of OAM mode met $$-\frac{N}{2} < \alpha < \frac{N}{2}$$

(N is the number of antenna elements).

For the traditional method, because the OAM mode number $\alpha$ need to meet $$-\frac{N}{2} < \alpha < \frac{N}{2}$$

(N is the number of antenna elements), 8 elements UCA could synthesize the vortex EM wave carrying OAM mode 3, but not the vortex EM wave carrying OAM mode 10. However, in Example 1, 8 antenna elements were successfully used to synthesize the vortex electromagnetic field with a mode number of 10, which indicated that the method of the present invention could achieve the synthesis of vortex EM wave carrying higher OAM mode than the traditional UCA. Through increasing the rotation times, and the phase adjusting the feeding phases to the antenna element, our required vortex EM wave can be generated efficiently.

Moreover, since the number of the generated OAM mode influenced the azimuth resolution of the imaging system, the method of the present invention could also be used to increase the azimuth resolution of the imaging system, which was beneficial to realize the super-resolution imaging and that might be used for super-resolution biomedical imaging.

Figure 1:
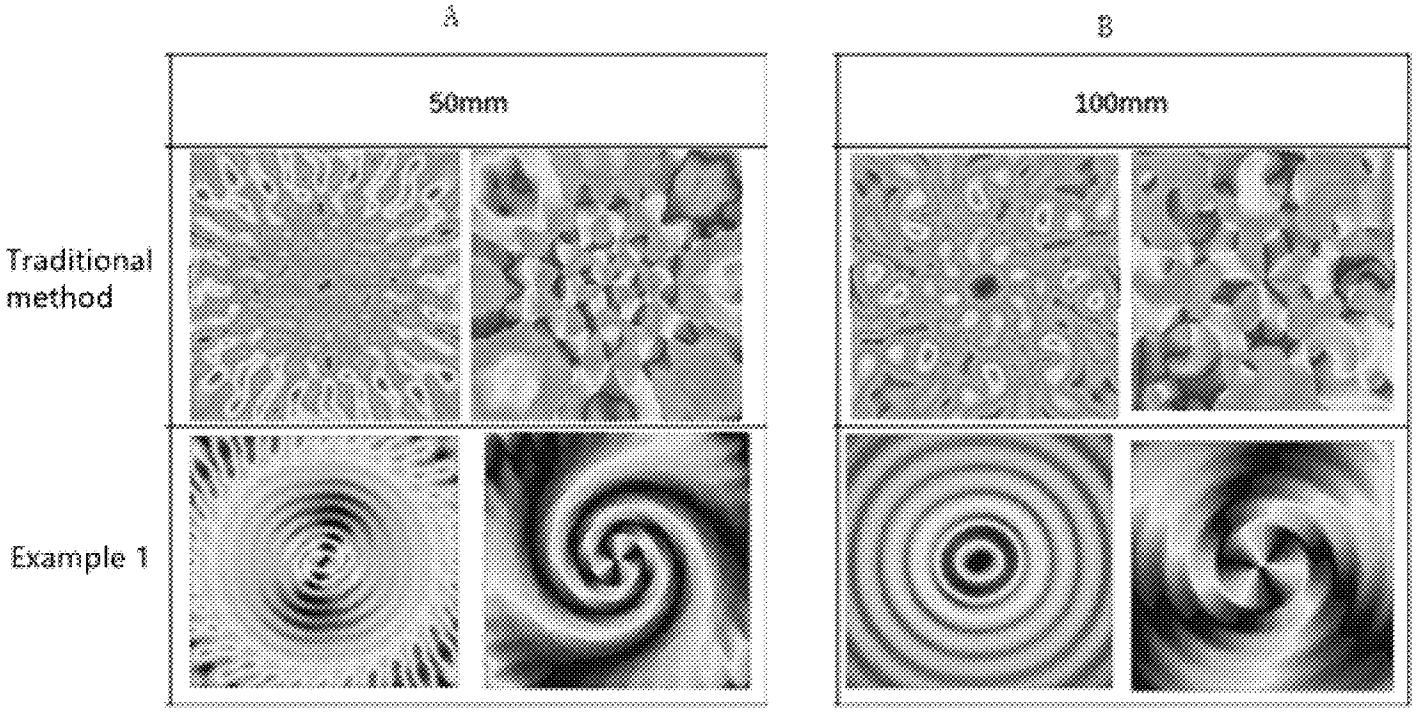
FIG. 1: Comparison of the purity of the vortex EM wave under different observation distances (50 mm, 100 mm) (A is the intensity, and B is the phase). The antenna array has 8 antenna elements, and the array radius is 140 mm.

In addition, compared with the traditional method, the method of the present invention could also generate vortex EM wave of high quality. The purities of the generated OAM modes were higher, which could be seen from FIG. 1. Compared with the traditional UCA, the vortex EM wave synthesized by the method of the present invention had higher modal purity, lower imaging noise, and better imaging performance.

In summary, the present invention provided a novel SUCA method for generating vortex EM wave carrying high OAM mode. By rotating the array elements to various spatial locations, modifying their feeding phases, and superimposing the generated fields at various spatial locations, SUCA could beat the limit of space and configure more array elements to generate vortex EM waves carrying high mode OAMs. Meanwhile, due to the more synthetic array elements and smaller aperture than the traditional UCA, the purity of OAM mode was higher and it was more flexible to adjust the main lobe directions of these vortex waves carrying different OAM modes, and could generate vortex EM waves. In conclusion, with the special advantages, our proposed SUCA was potential to generate high quality vortex EM waves carrying high mode OAMs, which could be used to improve the azimuth imaging resolution. Our proposed method was potential to OAMs' application, such as super-resolution biomedical imaging, radar imaging, wireless communication and so on.

The invention claimed is:

1. A synthetic uniform circular array (SUCA) method for generating vortex electromagnetic (EM) wave, characterized in that the method is to form a radially placed uniform circular antenna array (UCA) with N elements, where N is a positive integer, and then by rotating the array elements to various spatial locations, modifying their feeding phases, and superimposing the generated fields at various spatial locations, vortex electromagnetic (EM) waves can be generated;

the method includes the following steps: (1) N antenna elements are arranged on a circular ring to form an UCA; (2) N antenna elements are fed at the initial position to emit EM waves with the initial phase; (3) By rotating the array elements to various spatial locations and modifying their feeding phases, the phase-controlled EM waves are emitted; (4) The EM waves emitted in step (2) and step (3) are superimposed to generate vortex EM waves;

said step (1) also includes determining the OAM mode number α' of the synthesized vortex EM wave, and determining the elements number Ns of the virtual synthesized antenna array; where Ns=kN, k>0, and k is an integer;

in said step (2), the phase of the EM wave emitted by the $n^{th}$ element is:

$$\alpha' * \frac{2\pi(n-1)}{N},$$

where 1≤n≤N, and n is an integer;

the specific operation method of step (3) is: rotating the antenna array around the central axis of the ring in a set direction, and feeding the N antenna elements for emitting the EM waves from the position after rotation;

the antenna array is rotated a total of s times, and the angle of each rotation is $$\frac{2\pi}{N_s};$$

after the antenna array is rotated for the $i^{th}$ time, the phase of the EM wave emitted by the $n^{th}$ antenna elements is:

$$\alpha' * \frac{2\pi(n-1)}{N} + \alpha' * \frac{2\pi}{N_s} * i;$$

wherein, s=k−1; 1≤i≤s, and the rotation direction is clockwise or counterclockwise.

2. The method according to claim 1, characterized in that the antenna element is a circularly polarized antenna.

3. The method according to claim 1, characterized in that the antenna element is a linearly polarized antenna In step (3), after each rotation of the antenna array, each antenna element also needs to rotate $$\frac{2\pi}{N_s}$$

around itself in a direction which is opposite to the rotation of the antenna array.

4. The method according to claim 1, characterized in that in step (1), the N antenna elements are evenly arranged on a circular ring.

5. The method according to claim 1, characterized in that in step (3), the rotation is controlled by a precision rotating platform; and/or, the radius of the circular antenna array is adjustable.

6. The vortex EM wave synthesized by the method according to claim 1.

7. The vortex EM wave according claim 6 is used for super-resolution biomedical imaging, communication, or radar imaging.

8. The method according to claim 5, characterized in that the radius of the circular antenna array can be adjusted according to the OAM mode number of vortex EM wave or the requirements of imaging system.

9. The method according to claim 2, characterized in that in step (1), the N antenna elements are evenly arranged on a circular ring.

10. The method according to claim 3, characterized in that in step (1), the N antenna elements are evenly arranged on a circular ring.

11. The method according to claim 2, characterized in that in step (3), the rotation is controlled by a precision rotating platform; and/or, the radius of the circular antenna array is adjustable.

12. The method according to claim 3, characterized in that in step (3), the rotation is controlled by a precision rotating platform; and/or, the radius of the circular antenna array is adjustable.

13. The vortex EM wave synthesized by the method according to claim 2.

14. The vortex EM wave synthesized by the method according to claim 3.

15. The vortex EM wave synthesized by the method according to claim 4.

16. The vortex EM wave synthesized by the method according to claim 5.

17. The vortex EM wave synthesized by the method according to claim 8.

* * * * *